United States Patent [19]

Rowe

[11] 4,116,421

[45] Sep. 26, 1978

[54] METHOD OF SEALING TAPHOLES IN A PHOSPHORUS FURNACE

[75] Inventor: Jerry Rowe, Pocatello, Id.

[73] Assignee: FMC Corporation, Philadelphia, Pa.

[21] Appl. No.: 818,936

[22] Filed: Jul. 25, 1977

[51] Int. Cl.[2] ..... C21B 7/12

[52] U.S. Cl. ..... 266/45; 266/272

[58] Field of Search ..... 266/44, 45, 271, 272

[56] References Cited

U.S. PATENT DOCUMENTS

| | | | |
|---|---|---|---|
| 1,537,901 | 5/1925 | Tharaldsen | 266/45 |
| 3,973,761 | 8/1946 | Pelletier et al. | 266/272 |

*Primary Examiner*—Gerald A. Dost

*Assistant Examiner*—Paul A. Bell

*Attorney, Agent, or Firm*—Robert D. Jackson; Frank Ianno

[57] ABSTRACT

A method of closing phosphorus furnace tapholes which comprises applying pneumatic pressure at the taphole opening to force molten material in the boretube back into the furnace and then introducing sand particles through the taphole to meet and effect solidification of incoming molten furnace material thereby sealing off the inner opening of the boretube and filling the remainder of the boretube with sand. Tapping is readily accomplished by blowing out the loose sand and breaking the inner seal of solidified furnace material.

5 Claims, 2 Drawing Figures

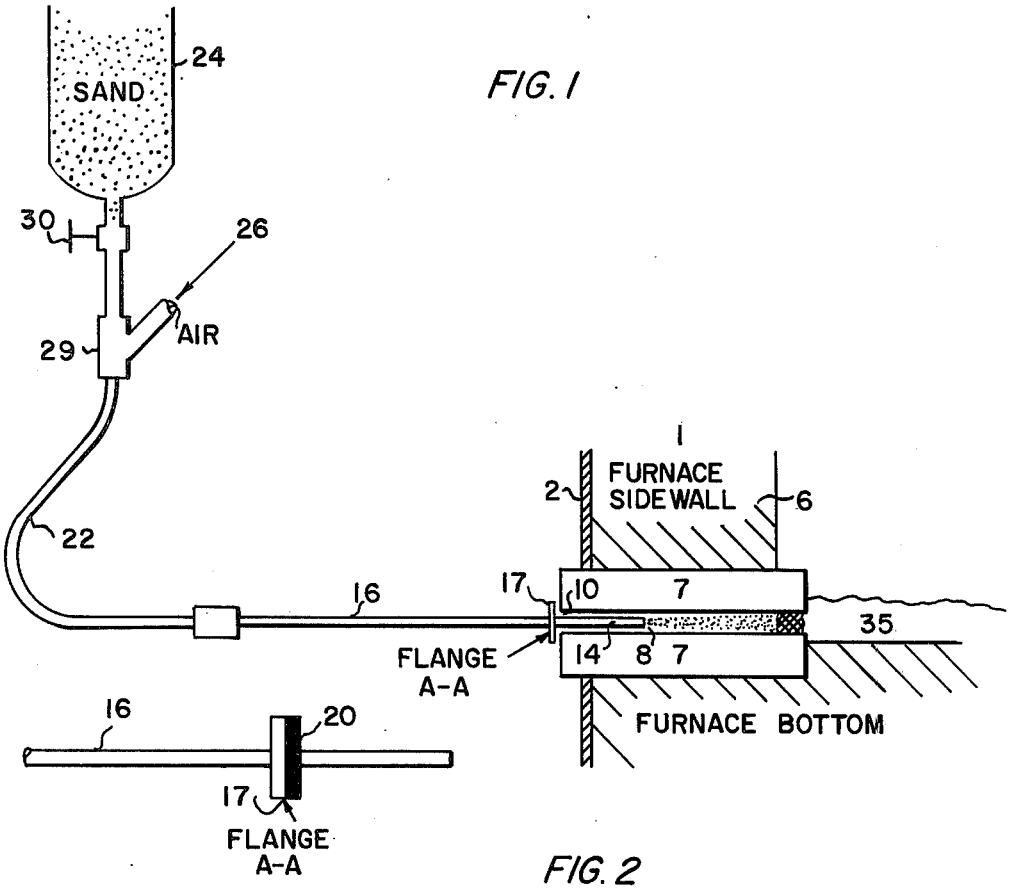
FIG. 1
FIG. 2
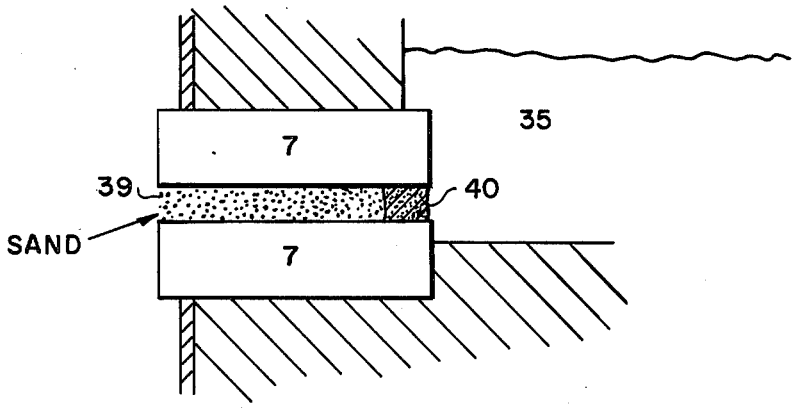

METHOD OF SEALING TAPHOLES IN A PHOSPHORUS FURNACE

This invention pertains to metallurgical furnaces such as electric phosphorus furnaces and more particularly to improvements in tapping procedures.

Elemental phosphorus is produced by melting and reacting in a submerged arc electric furnace a mixture of phosphate ore, a carbon reductant such as coke and a flux such as silica rock. Phosphorus vapor is liberated from the melt, collected overhead and condensed to liquid form. After the reaction is completed, the residual molten materials, separated by density into slag and ferrophos metal, are periodically drained through tapholes which are the outer openings of boretubes situated in the furnace walls. The molten streams are conveyed to cooling and disposal areas.

Tapping of phosphorus furnaces is a difficult and onerous operation owing to the high temperature (up to about 2800° F. or 1538° C.) and erosive nature of the molten material and attendant fumes. In one prior tapping procedure, pneumatic rotary drills are used to break through hardened clay tap plugs and solidified material to allow the molten furnace contents to drain. Another known method of opening taps includes the use of an oxygen lance to burn out the solidified material. A further known method is to partially drill the hole and then complete the tapping using an oxygen lance.

An oxygen lance is a section of metal pipe through which is passed a stream of oxygen. On contact with an ignition source, the pipe end becomes incandescent by combusting with the oxygen to form a tip of deflagrating metal which burns out the clay plug, allowing the molten material to drain from the furnace. After drainage is completed, the furnace opening is closed with a fresh clay plug. Such clay plugs are fabricated in a mud mill situated on the plant premises.

Plugging of metallurgical furnaces with clay requires more than one man and since it is carried out in close proximity to the tap openings, the job can be hazardous. Moreover, the use of clay plugs, which must be prepared in advance of each plugging and contain the correct moisture content, necessitates furnace load reductions and curtailments up to 10 minutes while the taphole is being closed to minimize pressure from within the furnace and risk of injury. Electric power is generally paid for on a contract basis regardless of consumption so that failure to utilize power demand decreases plant productivity.

An improved method of plugging tapholes is described in U.S. Pat. No. 3,599,953. In this technique, shaped green wooden plugs are inserted into the tapping sleeve at the end of a tap. This causes solidification of molten material adjacent to the plug thereby sealing the taphole. The wood plug is converted into charcoal due to heat and absence of air.

Use of wooden plugs provides a simpler method of plugging and opening taps since pre-drilling of the tap is unnecessary. The charred plug is burned out with the oxygen lance which is easier than removing clay plugs and causes less damage to the boretubes.

However, wood plugs are not entirely satisfactory. They are more expensive than clay and load reductions may be needed to relieve furnace pressure. They are easier to insert, but personnel are still exposed to splattering molten material generated when moisture in the green wood turns to steam.

A recent advance in plugging phosphorus furnace tapholes is the subject of pending application Ser. No. 663,845, filed Mar. 4, 1976, now U.S. Pat. No. 4,030,709, and assigned to the FMC Corporation. In this approach, a plug of matted ceramic fibers such as a hollow cone, is placed over a backing plug and the assembly inserted into the taphole by means of a long handle attached to the base of the backing plug. The backing plug is maintained in place until the molten furnace material solidifies against the ceramic plug thereby sealing off the taphole. The ceramic plugs are generally easier to handle and are more readily placed in the taphole than the prior clay and green wooden plugs. Unlike the latter, ceramic plugs are essentially moisture free and thus do not cause splattering of molten furnace material. Being flexible and compressible, the ceramic conical plugs tend to conform to irregularities in the boretubes, thereby forming a positive seal and effectively stopping flow of molten material.

Although there have been improvements in the plugging of phosphorus furnace tapholes, it continues to be a difficult and cumbersome procedure. Why this aspect of the phosphorus refining art is still relatively undeveloped can best be appreciated by considering the nature of the tapping operation. The closing of phosphorus furnace tapholes is not merely a matter of inserting a plug in the taphole opening to shut off the flow of molten furnace material; that is to say, the situation is not akin to replacing the stopper in the side of a water jug after draining off some of the water. When a plug is placed in a furnace taphole, the flow of molten material is blocked. However, the molten material in contact with the face of the plug commences to solidify due to heat loss through the plug. Eventually, that section of the boretube between the plug and inner opening is filled with solidified furnace material and it is this congealed substance which seals the furnace taphole. When the furnace is ready to be tapped, the solidified material and the remains of the original plug are melted out using an oxygen lance. Since the boretube is about 50 inches in length and a substantial portion behind the taphole plug is filled with solidified melt, several sections of pipe may be required to burn through the seal. Moreover, extensive use of the oxygen lance is highly detrimental in that it causes severe erosion of the boretube which becomes enlarged and of irregular contour making subsequent tapping even more difficult; and, frequent replacement of the boretube is necessary.

Although the green wooden plugs aforesaid of cited U.S. Pat. No. 3,599,953 are long enough to fill the boretube and thus minimize outflowing of furnace melt, the charred remains of the plug must be burned out and this likewise requires use of the oxygen lance and much damage to the boretube walls.

From the foregoing, it is manifest that the use of plugs or stopples for effecting closure of furnace tapholes is not entirely satisfactory.

In accordance with the present invention, there is provided a method of stopping the flow of molten material from a metallurgical furnace having located on its outer wall at least one taphole which is the outer opening of a boretube communicating with the furnace interior comprising applying sufficient pneumatic pressure at the taphole to displace molten material from the boretube then introducing particulate material into the resulting boretube space whereby a zone of solidification is formed in the boretube where the particulate material contacts molten furnace material thereby stopping the outward flow of molten material.

In carrying out the invention herein, the first step is the application of sufficient pneumatic pressure at the furnace taphole in order to force molten material from the boretube back into the interior of the furnace. In the case of phosphorus furnaces with which the invention is particularly concerned, the requisite pressure is moderate since such furnaces operate normally at pressures not much higher than atmospheric. After displacing molten material from the boretube, a stream of particulate material is introduced through the taphole and into the boretube. When the particulate material encounters the molten furnace material, the latter is cooled below its melting temperature, thereby forming in the vicinity of contact a zone of solidification which seals off the boretube at that point and stops the outward flow of molten material. Introduction of particulate material is continued until a sufficient quantity has been added to act as a heat sink for the plug of solidified material and thereby prevent its being remelted. This is most conveniently effected by injecting the particulate material until the boretube is completely filled. This insures that enough particulate material is present to maintain the plug of solidified material below its melting point.

Pneumatic pressure for displacing the molten furnace material from the boretube is provided by compressed gas, preferably air since it is convenient to use and low in cost. If an inert gaseous medium is called for, nitrogen is recommended, although any unreactive gas would be suitable.

The particulate material can be any granular or pulverulent substance which on contact with the molten furnace material lowers its temperature sufficiently whereby solidification occurs and the boretube is sealed off by the congealed mass. Since the temperature of the molten furnace material is about 2,800° F., the particulate material must be sufficiently inert and refractory to contain the molten furnace material and have sufficient heat conductivity to prevent remelting of the solidified plug. An especially convenient and suitable particulate material is ordinary silica sand or similarly inert mineral substance. Particle size and distribution of the particulate material is not critical and it can be a mixture ranging from fine powder to small pebbles.

In effecting closure of metallurgical furnace tapholes in accordance with this invention, a tubular member such as a steel pipe is connected at one end to a compressed air line into which sand can be admitted from a sand supply tank. With the air turned on, the pipe is inserted into a taphole for a distance of about 8 to 10 inches. A flange welded to the pipe regulates the distance penetrated into the boretube and also acts as a seal to retard leakage of molten material from the taphole. The air pressure quickly forces the molten material through the boretube and into the furnace. At this point, the valve in the sand supply line is opened and sand is picked up by the air and injected from the nozzle end of the pipe into the boretube. Since the sand is propelled deep within the boretube, solidification of the furnace material can be effected near the inner opening of the boretube. The space between the solidified plug and taphole is filled with sand which conducts heat away from the plug to prevent it from remelting.

Tapping of the phosphorus furnace tapholes closed in accordance with the process of the invention is much easier and simpler than where closure is effected by means of plugs in the methods heretofore. The sand is first removed from the boretube and then the inner plug of solidified furnace material removed to permit the slag or ferrophos metal to be drained. Removal of the sand is effected by blowing it out using an air lance: a section of pipe attached to a source of compressed air. Once the sand has been removed, the solidified material commences to soften and gives way under the hydrostatic pressure and heat from the furnace melt or is reliquified by means of a short section of oxygen lance. Since minimal oxygen is required to reopen the taphole, the boretube is subjected to much less erosion and oxidation than when burning out longer sections of solidfied melt or the carbonized remains of wooden plugs as in the procedures heretofore. As a consequence, the process of the invention greatly decreases the frequency of boretube replacement with reduction in operating costs and downtime.

FIG. 1 of the drawing is a cross sectional view through an electric phosphorus furnace showing closure of tapholes by the process of the invention.

FIG. 2 of the drawing is a cross sectional view of the electric phosphorus furnace after closure of the tapholes by the process of the invention.

Referring to FIG. 1 of the drawing, 1 is a section of a phosphorus furnace side wall having outer stainless steel shell 2 and lined on the inside with several courses of carbon graphite brick 6. Located in furnace wall 1 is a carbon sleeve 7 containing boretube 8 through which molten furnace material flows during tapping and is drained off by way of taphole opening 10. Protruding inwardly through taphole opening 10 is tip portion 14 of metal pipe 16. Tip portion 14 of the metal pipe is about 6 inches long. Pipe 16 is a convenient length of standard 21 foot sections of metal pipe. A washer or flange 17 divides pipe tip 14 from the main body portion of pipe 16. The flange is used to effect a surface seal against the taphole opening. The flange 17 can be cladded with a heat resistant material 20. Pipe 16 is connected by way of flexible hose 22 to sand supply container 24 and air supply line 26. Connector 29 serves to admit the sand and/or air pipe 16.

In carrying out the herein process, the tapping operator inserts the tip 14 of pipe 16 into taphole opening 10 until the flange 17 is seated firmly against the face of said opening. While holding pipe 16 in place, air is admitted therein through line 26. Air enters boretube 8 from pipe tip 14 and the resultant air pressure forces molten material from the boretube back into the furnace while stopping further outward flow. Air pressure for holding back the molten furnace material is slightly above that of the static head inside the furnace. At this point, valve 30 at the bottom of sand supply vessel 24 is opened and sand is permitted to flow out of sand vessel 24 and be picked up by air entering connector 29. The sand/air mixture is conveyed to the opening in pipe tip 14 from where it is propelled through the boretube 8 to meet molten furnace material 35 at the inner boretube opening. On encountering the stream of sand particles, solidification occurs at the inner boretube opening thereby effecting closure. Introduction of the stream of sand is continued until the remaining section of the boretube is completely filled. Tapping is readily accomplished by blowing the sand out of the boretube with a stream of compressed air issuing from the end of a pipe or tube inserted in the taphole opening. The plug becomes soft after the sand is removed and melting of the plug is accelerated by using an oxygen lance.

FIG. 2 of the drawing shows the taphole in the furnace of FIG. 1 sealed in accordance with the process of the invention.

In FIG. 2, 40 designates the plug of solidified furnace material located inside the inner opening of boretube 8. Reference number 39 identifies the sand filled portion of boretube 8.

The process of the invention is effective for closing tapholes in any type of metallurgical furnace wherein the molten materials are amenable to solidification by injection ofparticulate material as set forth herein.

As an example of closing phosphorus furnace taphole by the process of the invention, the reservoir 24 is filled with sand, preferably compound of particles no larger than about $\frac{3}{8}$ inch. With sand control valve 30 in the closed position, air is admitted through line 26 and pipe 16 inserted in taphole 10 until flange 17 contacts the face of the taphole. Air pressure builds up in boretube 8 and displaces molten material 35 back into the furance interior. Sand control valve 30 is opened and a stream of sand is introduced into the boretube 8 via nozzle portion 14 of pipe 16. The sand flow is sufficiently adjusted whereby sufficient sand is propelled down the boretube 8 to meet incoming furnace material and effect solidification at the inner end of the boretube 8. Introduction of the sand is continued until the boretube is filled. The closure of the taphole as above described is generally effected in about 1 minute.

What is claimed is:

1. A method of closing a taphole in a metallurgical furnace, which comprises applying sufficient pneumatic pressure at the taphole to displace molten material from the boretube, then introducing particulate material into the resulting boretube whereby a zone of solidification is formed in the boretube where the particulate material contacts molten furnace material thereby stopping the outward flow of molten material.

2. A method of closing a taphole in a phosphorus furnace, which comprises applying sufficient pneumatic pressure at the taphole to displace molten material from the boretube, then introducing particulate material into the resulting boretube whereby a zone of solidification is formed in the boretube where the particulate material contacts molten furnace material thereby stopping the outward flow of molten material.

3. The method of claim 2 wherein the refractory particles are sand.

4. The method of claim 2 wherein the pneumatic pressure is compressed air.

5. The method of claim 2 wherein the boretube is filled with the particulate material.

* * * * *